US005611176A

United States Patent [19]

Juengert et al.

[11] Patent Number: 5,611,176

[45] Date of Patent: Mar. 18, 1997

[54] ANTENNA SUPPORT STRUCTURE

[76] Inventors: Robert P. Juengert, 32 Jarmy La., Manahawkin, N.J. 08050; Edward Weingart, 15 Whispering Hills Dr., Annandale, N.J. 08801

[21] Appl. No.: 457,161

[22] Filed: Jun. 1, 1995

Related U.S. Application Data

[63] Continuation of Ser. No. 205,596, Mar. 2, 1994, abandoned, and a continuation-in-part of Ser. No. 1,036, Nov. 2, 1992, abandoned.

[51] Int. Cl.[6] ..... F04H 12/00

[52] U.S. Cl. ..... 52/40; 52/296; 52/736.2; 52/736.3; 428/18

[58] Field of Search ..... 52/40, 726.4, 736.1, 52/736.2, 736.3, 738.1, 295, 296; 428/7, 8, 9, 10, 18, 19, 20

[56] References Cited

U.S. PATENT DOCUMENTS

| | | | |
|---|---|---|---|
| D. 56,339 | 10/1920 | Carter . | |
| D. 210,293 | 2/1968 | Deneen . | |
| D. 340,003 | 10/1993 | Wright et al. . | |
| D. 349,707 | 8/1994 | Drake . | |
| 860,406 | 7/1907 | McGahan . | |
| 2,080,523 | 5/1937 | Williams et al. . | |
| 2,166,002 | 7/1939 | Fritsch . | |
| 2,204,286 | 6/1940 | Stevens . | |
| 2,885,673 | 5/1959 | Bittner et al. . | |
| 3,144,375 | 8/1964 | Day . | |
| 3,164,344 | 1/1965 | Whyte . | |
| 3,603,780 | 9/1971 | Lu | 428/20 |
| 3,821,745 | 6/1974 | Bogner . | |
| 3,829,349 | 8/1974 | Hermanson . | |
| 4,855,167 | 8/1989 | Biehl . | |
| 5,085,900 | 2/1992 | Hamlett | 428/18 |
| 5,104,467 | 4/1992 | Johnson . | |

FOREIGN PATENT DOCUMENTS

| | | | |
|---|---|---|---|
| 553837 | 1/1957 | Belgium | 428/20 |

*Primary Examiner*—Michael Safavi
*Attorney, Agent, or Firm*—Lerner, David, Littenberg, Krumholz & Mentlik

[57] ABSTRACT

An antenna support structure is in the form of a tree. The structure includes an armature and a plurality of pipes connected to the armature to define a skeleton. A layer of epoxy is applied over the skeleton and is surface molded to resemble the bark of actual tree trunks, limbs and branches. Artificial foliage is then assembled to the limbs and branches to resemble the leaves or needles of a tree. Antenna mounting assemblies are joined to the skeleton and positioned so that the receiving and transmitting antennas mounted thereon are largely hidden from view by the limbs, branches and foliage of the tree. The materials from which the limbs, branches and foliage are fabricated have been specifically selected so as to not interfere with the radio signals being transmitted from or received by the antennas. The antenna support structure is capable of supporting antennas in an inconspicuous manner which does not detract from the aesthetics of the location in which it is installed.

11 Claims, 5 Drawing Sheets

ANTENNA SUPPORT STRUCTURE

This is a continuation of application Ser. No. 08/205,596 filed Mar. 2, 1994, abandoned and a continuation-in-part of design application Ser. No. 29/001,036 filed Nov. 2, 1992, abandoned.

FIELD OF THE INVENTION

The present invention relates to antenna support structures, and more particularly to antenna support structures which are camouflaged so as to blend inconspicuously into the surrounding environment.

BACKGROUND OF THE INVENTION

As a result of the relatively recent advent of cellular telephone systems, users are now able to take a telephone with them for communication to or from almost any location. Briefly stated, these systems consist of a plurality of sites, referred to as cell sites, at which transmitting antennas, receiving antennas and attendant electronics are located. Telephone signals are transmitted through free space transmission between cellular telephones, such as mobile phones and portable phones, and these cell sites. Since the signals travel on a line of sight between the user's cellular telephone and the transmitting and receiving antennas, the antennas are typically mounted at relatively high elevations to minimize any interference. Cables and sophisticated switching systems link the cell sites together so that the signals can be transferred from one cell site to another cell site depending upon the movement of the user.

In the infancy of the cellular communications industry, cellular systems were installed in urban areas and needed only a minimum number of cell sites in order to cover these areas and accommodate the relatively low volume of calls they were handling. Because of their urban locations, these cell sites often consisted of the inconspicuous placement of transmitting and receiving antennas on existing tall structures, such as buildings and water towers. Where such structures were not available, separate towers were built to support the antennas at a high elevation. Since these towers had to have superior strength to withstand enormous wind shear forces and environmental exposure, they were and still are typically built from an unsightly latticework of steel, and are most often the tallest, most prominent structures in the area. Fortunately, the placement of these towers in heavily industrialized areas had only minimal impact on the aesthetics of the area and therefore their approval and construction met with little resistance.

The proliferation of cellular communications has now created the need for an expanded area of coverage and for a denser array of cell sites to handle the ever increasing volume of use. Since many of the readily available sites have already been taken, the search for new cell sites has become increasingly difficult. To a large extent, the reason for this has been the need to place these newer cell sites in undeveloped areas and in largely residential suburban locations, neither of which typically has tall buildings or other such structures on which transmitting and receiving antennas can be mounted. Even when such structures are available, cellular companies are most often faced with enormous burdens in attempting to obtain approval to mount the antennas on these structures from reluctant local zoning boards. Where tall structures are not already available, local residents, zoning boards and environmental groups are almost always steadfastly opposed to the construction of tall antenna support towers because of the negative impact these unsightly towers would have on the aesthetics of the undeveloped areas and the aesthetics of their residential communities.

Cellular companies are therefore faced with a dilemma. They must create additional cell sites in order to accommodate the increasing demand for cellular communications, yet the enormous cost, in terms of both money and time, to gain approval for new antenna installations has impeded their ability to provide this expanded coverage.

There therefore exists a need for a way in which the transmitting and receiving antennas of cellular communications systems can be installed inconspicuously at high elevations so as to not raise objections from the governing bodies and residents of local communities or from environmental groups. More particularly, there exists a need for an antenna support tower which is strong and durable, yet which is aesthetically pleasing so as to create a cell site which will not detract from the appearance of the area in which it is installed. Preferably, such antenna support tower will blend inconspicuously into the environment in which it is constructed.

SUMMARY OF THE INVENTION

The present invention addresses these needs by providing an antenna support structure which is configured in the shape of a tree wherein the antennas being supported are substantially obscured by the limbs, branches and foliage of the tree. The antenna support structure is built upon a frame which includes an elongated hollow pole extending from a base end to a top end and defining the trunk of the tree. A flange at the base end of the pole provides a mechanism for securely installing the antenna support structure on a footing in the ground.

The frame may further include a plurality of pipe assemblies connected to the pole for defining the configuration of the tree limbs. Each pipe assembly may include a series of nonmetallic pipe segments of progressively decreasing diameter connected to one another in end to end fashion. Preferably, the pipe segments are not connected to one another colinearly, but rather an angle is defined between adjacent pipe segments to simulate the natural appearance of a tree limb. Subassemblies of the pipe segments may be connected to the pipe assemblies to define branch configurations extending from the tree limbs. In preferred embodiments, the pipe assemblies and subassemblies are formed from polyvinyl chloride pipe cut to desired lengths and glued together in desired configurations. By forming these assemblies from nonmetallic materials they will not interfere with the radio signals being transmitted by and received by the antennas mounted to the support structure.

The frame, including the elongated hollow pole, the pipe assemblies and the subassemblies, may be coated with a layer of a strong, durable material such as a curable epoxy resin. A plastic lath may be applied to the frame before coating to provide a more adherent surface for the coating. Prior to curing, the surface of the coating preferably is textured and subsequent to curing preferably is painted to resemble actual tree bark, thereby creating the natural appearance of a tree trunk, tree limbs and tree branches. A plurality of foliage assemblies may be connected to the tree limbs and tree branches to represent leaves. Each of the foliage assemblies preferably includes a stem and a multiplicity of strips of a material joined to the stem. Most preferably, both the stem and the strips of material are nonmetallic so as to not interfere with the local radio signals.

The top end of the elongated hollow pole includes means for mounting a plurality of antennas to the pole so that the antennas will be substantially obscured by the tree limbs, branches and foliage. The mounting means may include a first series of brackets for mounting one type of the antennas at a spaced distance from the pole and a second series of brackets for mounting another type of antennas to the pole at a distance greater than the spaced distance. In preferred embodiments, the mounting means provide for the pivotal movement of the antennas in a vertical plane so that the antennas can be "focused" to cover a certain range.

Any arrangement of mounting means may be devised depending upon the particular characteristics of the antennas being supported. Once the configuration of the mounting means has been developed, the arrangement of the limbs, branches and foliage can be selected to assure that the mounting means and antennas are substantially hidden from view.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

As described in the detailed description which follows and illustrated in the accompanying figures, the antenna support structure of the present invention is in the form of a white pine tree which is indigenous to most of the United States and many parts of the world. However, it will be appreciated that the antenna support structure of the present invention can be adapted to take the form of any type of tree, and would most suitably take the form of a tree which is indigenous to the area in which the antenna support structure is to be installed.

Figure 1:
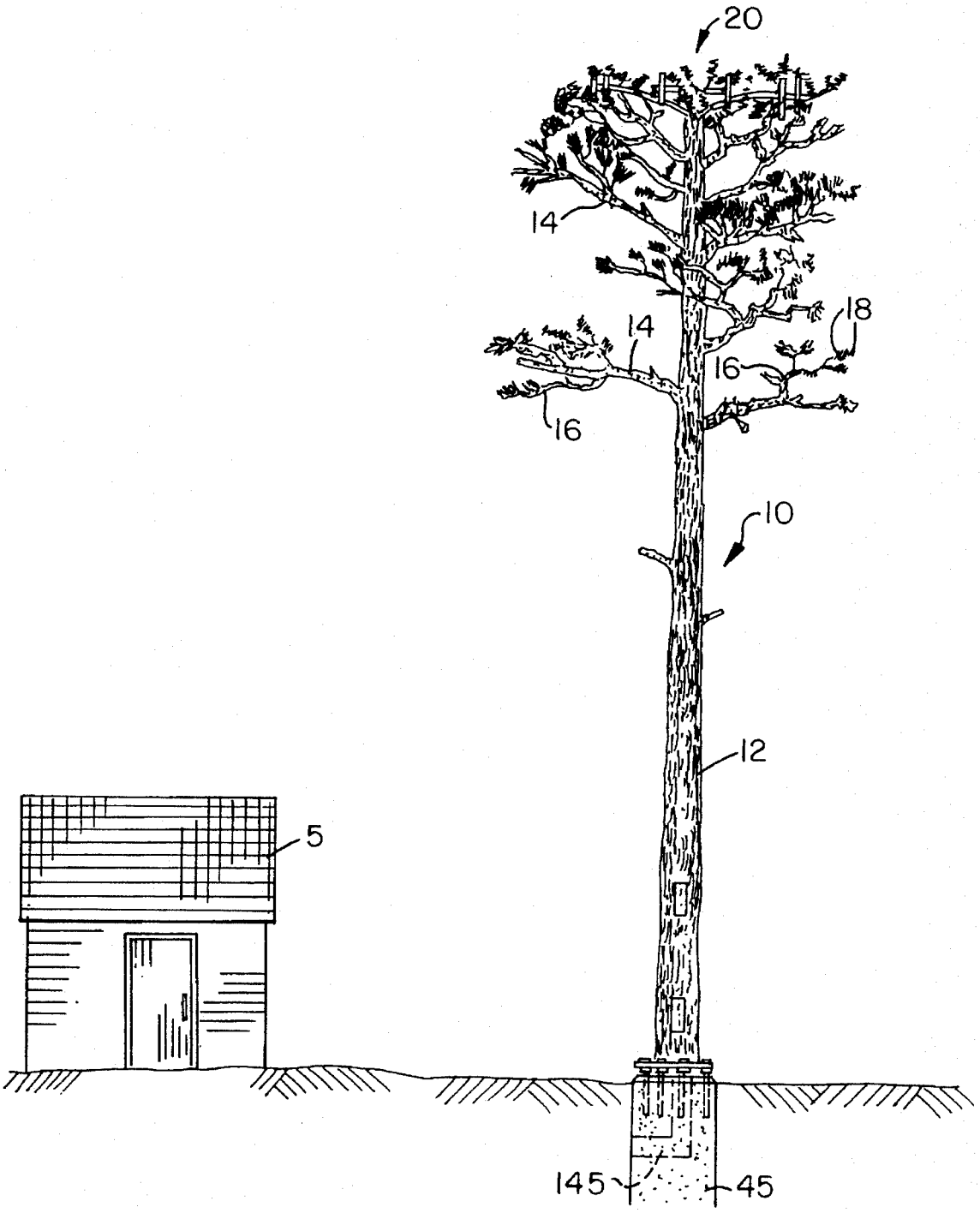
FIG. 1 is a front elevational view of a cell site including an antenna support structure in accordance with the present invention.
Figure 2:
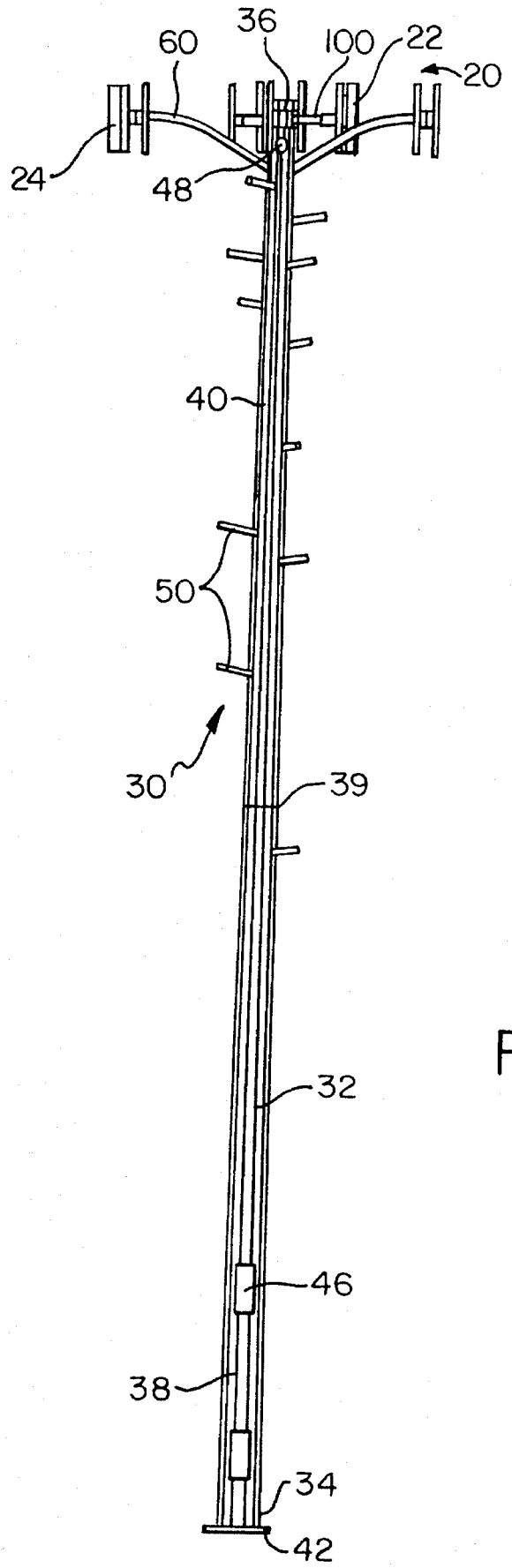
FIG. 2 is a front elevational view of the armature which forms the skeleton of the antenna support structure of the present invention.
Figure 3:
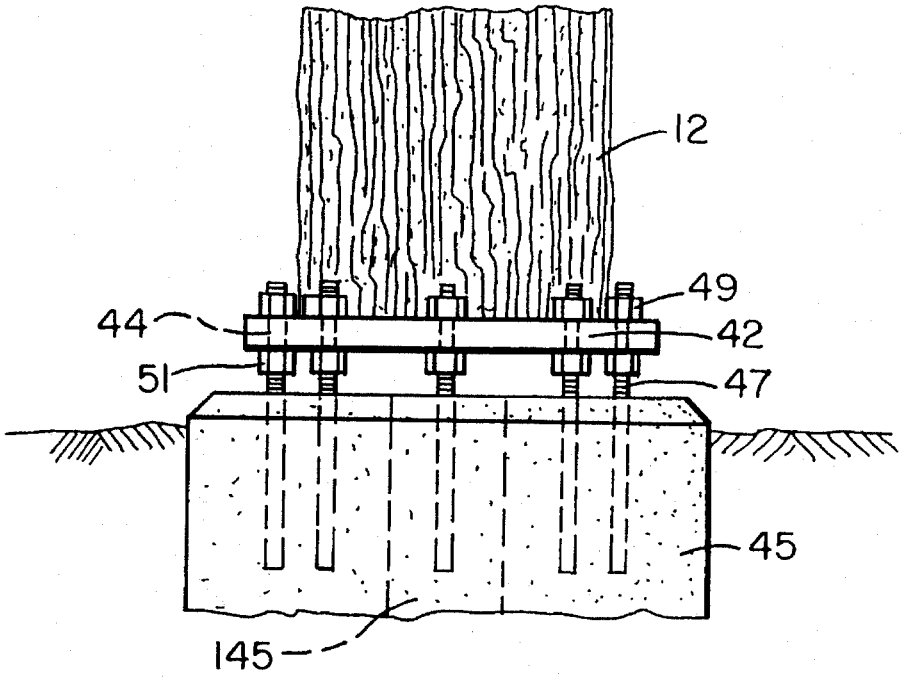
FIG. 3 is an enlarged front elevational view showing an arrangement for installing the antenna support structure of FIG. 1.

Referring to FIG. 1, there is illustrated a cell site including a control room 5 housing switching equipment and other electrical apparatus associated with cellular communications systems, and a preferred embodiment of an antenna support structure 10 in accordance with the present invention. As noted above, antenna support structure 10 is in the form of a tree including a tree trunk 12, a plurality of tree limbs 14, branches 16, and, in the case of the white pine tree described herein, a multiplicity of needles 18 formed on the branches. An antenna mounting system 20 is assembled near the top of support structure 10 so that, when transmitting antennas 22 and receiving antennas 24 (FIG. 2) are mounted by mounting system 20 to support structure 10, the limbs 14, branches 16 and needles 18 will largely obscure the antennas from view.

In designing and constructing antenna support structure 10, careful consideration must be given to the fact that the antenna support structure must be capable of enduring environmental exposure. In this regard, the antenna support structure must have sufficient strength to withstand enormous wind shear forces, and sufficient durability to withstand other environmental conditions, including temperature extremes, icing, freeze/thaw conditions, humidity, acid rain, etc.

A preferred method for fabricating antenna support structure 10 can be understood with reference to FIGS. 2–7. The process begins by supplying a frame or armature 30 on which the antenna support structure is to be built. Armature 30 serves as the frame for tree trunk 12, and includes an elongated hollow support pole 32 formed from a strong, weather resistant material such as, for example, galvanized steel, and having a structure similar to that of the poles typically used to support highway and other types of lighting. Thus, support pole 32 may have a constant, gradual taper from a bottom or base 34 having a relatively large diameter to a smaller diameter top 36. A cap (not shown) encloses the open end of top 36.

The overall length of support pole 32 is selected so that transmitting antennas 22 and receiving antennas 24 will be supported at an adequate elevation to provide line of sight communications with users. Typically, pole 32 will have an overall height of at least about 60 feet, with heights of about 80 feet and more not being uncommon. To ease fabrication and installation, pole 32 is preferably formed in at least two segments 38 and 40 which may be telescopically connected to one another at a joint 39, as described further below. For poles 32 which are excessively long, three or more segments may be joined together.

A base plate 42 having a plurality of apertures 44 may be welded or otherwise connected to the base 34 of bottom pole segment 38 for connecting antenna support structure 10 to a foundation 45. Bottom pole segment 38 may also include one or more access ports 46 near the bottom of pole 32 for pulling coaxial cables (not shown) through antenna support structure 10 or otherwise providing access to the interior of pole 32 once installation has been completed. One or more access ports 48 may also be provided for the same purpose in top pole segment 40 near the top of pole 32.

Armature 30 further includes a plurality of pipes 50 which extend radially outward from pole 32 and which serve as connection points for the connection of tree limbs 14 to the tree trunk 12. Thus, the positioning of pipes 50 on pole 32 will depend upon the positions at which the limbs 14 are to protrude from the tree trunk. In a preferred arrangement, pipes 50 are formed from steel and are connected to pole 32 by welding or by another technique which will provide a strong and secure connection. Where relatively large and heavy tree limbs 14 are to be anchored to tree trunk 12, pipes 50 may be used having a diameter which is larger than the pipes used to anchor relatively smaller and lighter limbs. Thus, for example, pipes 50 having an outer diameter of about 3.625 inches may be used for anchoring heavy tree limbs 14, while pipes 50 having an outer diameter of about 2.0 inches may be used for anchoring lighter limbs. Moreover, pipes 50 are preferably assembled to pole 32 with a slight upward pitch, typically of about 8°, to prevent the limbs 14 from accidentally slipping off of pipes 50 during installation.

Figures 6, 8:
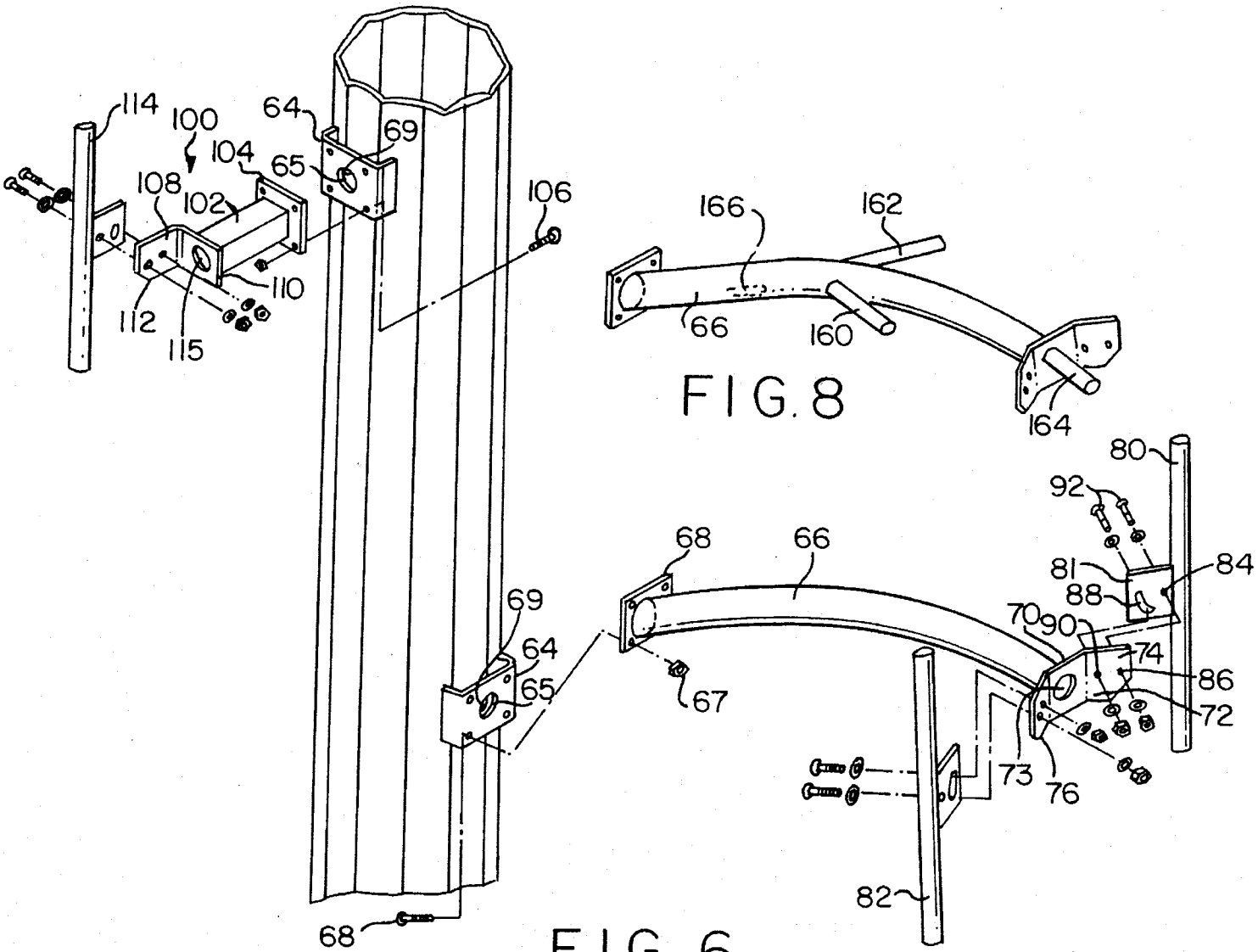
FIG. 6 is an enlarged exploded view showing the mounting assemblies for mounting antennas to the antenna support structure of FIG. 1.
FIG. 8 is an enlarged exploded view showing an alternate embodiment of one of the mounting assemblies shown in FIG. 6.

Adjacent top 36, pole 32 is provided with an antenna mounting system 20 including a plurality of antenna mounting assemblies for mounting the transmitting antennas 22 and receiving antennas 24 to antenna support structure 10. In a typical arrangement, mounting system 20 will include a total of six antenna mounting assemblies, three assemblies 60 for mounting receiving antennas 24 and three assemblies 100 for mounting transmitting antennas 22. Mounting assemblies 60 and 100 may be assembled to C-shaped brackets 64 which are welded or otherwise connected at evenly spaced intervals around the circumference of pole 32. As shown in FIG. 6, brackets 64 for assembling mounting assemblies 60 are connected to pole 32 at a spaced distance below brackets 64 for assembling mounting assemblies 100 so that all of the transmitting and receiving antennas will be positioned at approximately the same height. Each of brackets 64 includes an aperture 65 in alignment with an aperture 69 in pole 32 for feeding the cable leads (not shown) from the antennas to the interior of pole 32.

Mounting assemblies 60 include an elongated hollow arm 66 having a connecting plate 68 at one end thereof for connection to C-shaped bracket 64, for example, by nut and bolt fasteners 67. From connecting plate 68, arm 66 extends upwardly and outwardly, defining a downwardly curved arc, to an opposite end which includes a bracket 70. Preferably, the length of arm 66 is such that bracket 70 will be positioned at a distance of between about 4 feet and about 6 feet from pole 32. Bracket 70 includes a central plate 72 having an aperture 73 providing access to the interior of arm 66, flared plates 74 and 76 projecting at a forward angle outwardly from central plate 72, and a pair of mounting pipes 80 and 82 connected for pivotal movement to flared plates 74 and 76, respectively. In a preferred arrangement, mounting pipe 80 includes a radially projecting plate 81 having one aperture 84 which aligns with an aperture 86 in flared plate 74 and an elongated curved slot 88 which aligns with a second aperture 90 in flared plate 74. Mounting pipe 80 is thus connected to flared plate 74 by a pair of nut and bolt fasteners 92 so that the mounting pipe can be pivoted downwardly through an angle of about 30° with respect to the longitudinal axis of pole 32. Mounting pipe 82 has substantially the same structure as mounting pipe 80 and is pivotally mounted in a similar fashion to flared plate 76.

Mounting assemblies 100 include a straight hollow arm 102 having an end plate 104 connected at one end thereof for connection to a C-shaped bracket 64, such as by nut and bolt fasteners 106. The other end of arm 102 includes a generally L-shaped bracket 108, one leg 110 of which is connected to arm 102, an aperture 115 in leg 110 providing access to the interior of arm 102, and the other leg 112 of which extends outwardly therefrom for the connection of a single mounting pipe 114. Mounting pipe 114 has generally the same construction as mounting pipes 80 and 82 discussed above, and is connected to bracket 108 in essentially the same fashion so that it may be pivoted downwardly through an angle of about 30° with respect to the longitudinal axis of pole 32. Mounting assemblies 100 preferably are shorter in length than mounting assemblies 60. Most preferably, the length of mounting assemblies 100 is about 21 inches inclusive of arm 102 and L-shaped bracket 108.

Figure 4:
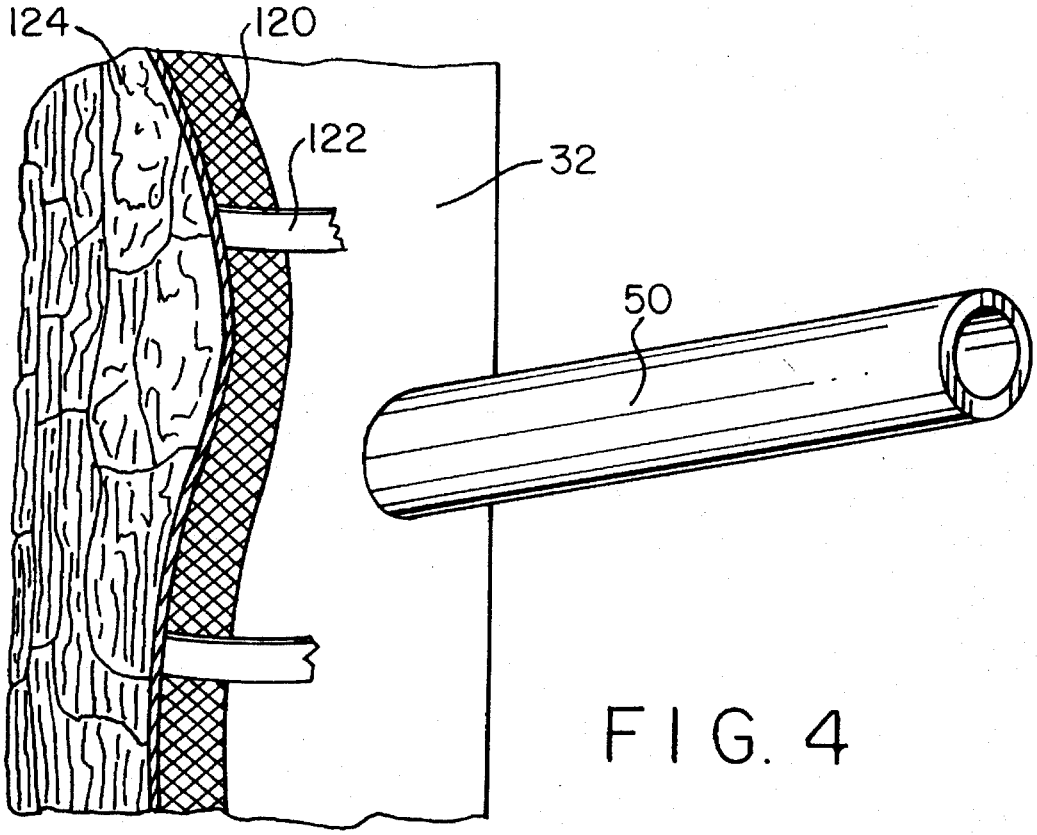
FIG. 4 is an enlarged partial view of the antenna support structure of FIG. 1, broken away to show the construction thereof.

In order to create the appearance of a tree trunk, pole segments 38 and 40 are covered with strong, durable materials which are then surface molded to recreate the texture of actual bark. Referring to FIG. 4, pole segments 38 and 40 are first covered with a plastic lath 120 which is held in place against the surface of the pole segments by conventional plastic straps 122 which are applied at spaced intervals along the length of the pole segments. Lath 120 is a sheet material having a plurality of holes which thus provides a gripping surface for the adherence of surface coatings to pole segments 38 and 40. In a preferred arrangement, an epoxy resin/hardener mixture is then applied in a layer 124 over lath 120 to coat the entire surface of pole segment 40, and to coat substantially the entire surface of pole segment 38, except for a short length at the top of pole segment 38 which slides into the bottom end of pole segment 40 for assembly thereto. Pipes 50 on either pipe segment are not coated. The epoxy resin/hardener mixture may be a conventional two-part epoxy system such as an aromatic diglycidyl compound that is reacted with a conventional hardener such as a diamine, and is preferably applied to pole segments 38 and 40 in a layer about 1.0 inch thick. Before the epoxy resin has cured, the surface of layer 124 is molded or textured to represent the bark of a tree, in this case a white pine tree. This is accomplished in accordance with well known techniques by creating a mold from the bark of a real white pine tree and then impressing that mold onto the epoxy layer 124 to duplicate the bark pattern therein. When the epoxy has cured to a rigid state, the mold is removed and non-metallic weather resistant paints, such as epoxy paints, are applied to layer 124 to give tree trunk 12 the natural color of bark.

Figure 5:
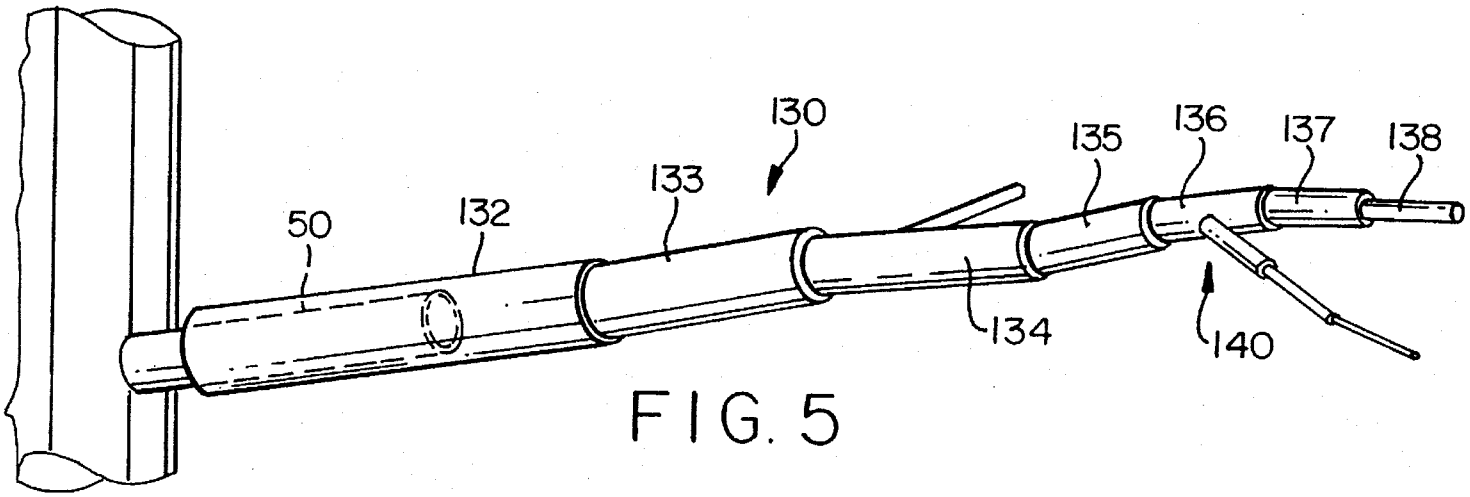
FIG. 5 is an enlarged partial view of the antenna support structure of FIG. 1, showing the pipe assemblies for forming tree limbs and branches.

Tree limbs 14 are created in desired configurations upon pipe assemblies 130. Pipe assemblies 130 may consist of a plurality of pipe segments 132–138 of progressively decreasing diameter which are joined together in succession with the end of the next smallest diameter pipe inserted into the end of the preceding pipe. The diameter of the innermost pipe segment 132 is preferably selected so that pipe segment 132 fits snugly over pipe 50 for connection to tree trunk 12. It will be appreciated that the pipe segments 132–138 need not be assembled colinearly. Rather, as shown in FIG. 5, pipe segments 132–138 are preferably joined together with each pipe segment oriented at a slight angle to the pipe segments on either side thereof in a random pattern so as to mimic the naturally random configuration of a tree limb. In a preferred embodiment, pipe segments 132–138 are formed from polyvinyl chloride pipe cut to appropriate lengths and glued together to create the desired effect.

Pipe assemblies 130 may also include subassemblies 140, also formed from interconnected pipe segments of decreasing diameter, which define the configuration of branches 16. Subassemblies 140 may be joined to pipe assemblies 130 by drilling holes at selected points in pipe segments 132–138 and gluing the subassemblies in place in these holes in patterns resembling the natural branch structures of trees. When pipe assemblies 130 have been completed, tree limbs 14 and branches 16 may be created by coating pipe segments 132–138 and subassemblies 140 with the epoxy resin/hardener mixture, and then surface molding and painting the epoxy coating to resemble natural tree bark.

Figure 7:
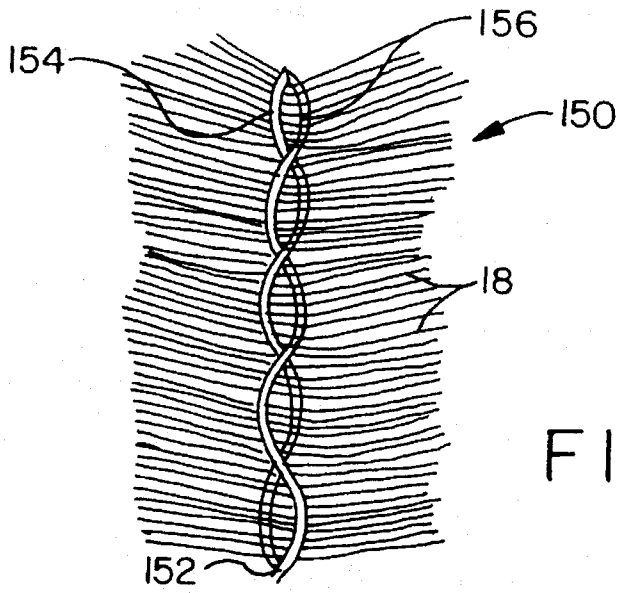
FIG. 7 is an enlarged front elevational view of a foliage assembly of the present invention.

Once the limbs 14 and branches 16 have been created, a multiplicity of artificial pine needles 18 are connected to the branches in the form of foliage assemblies 150. Needles 18 may be formed from a colored plastic material, such as, for example, green and brown polypropylene, in order to resemble naturally occurring pine needles. Foliage assemblies 150 may be formed in substantially the same manner as conventional bottle brushes. However, rather than the metal wires used to form the spine or stem in bottle brushes, the stems 152 of foliage assemblies 150 are fabricated from twisted rods 154 and 156 of a plastic material so as to not interfere with the radio signals being transmitted from and received by transmitting antennas 22 and receiving antennas 24, respectively. As shown in FIG. 7, as plastic rods 154 and 156 are twisted together, needles 18 are caught between adjacent twists, with the ends of rods 154 and 156 being glued together with epoxy or otherwise held together to prevent unravelling. The completed foliage assemblies 150 may be assembled to limbs 14 and branches 16 by inserting the stems 152 of the foliage assemblies into holes drilled at selected positions in the limbs and branches and epoxy gluing same in place.

The following will detail one procedure for installing antenna support structure 10 at a selected site. Initially, a concrete foundation 45 is poured to a sufficient depth to anchor antenna support structure 10 to the ground and to prevent same from toppling over in the event of excessive wind forces. Foundation 45 includes a conduit 145 providing a passageway for the antenna cables from the interior of pole 32 to an underground feed to control room 5, and a plurality of upwardly projecting bolts 47 arranged in a pattern for alignment with the apertures 44 in base plate 42. Before erecting tree trunk 12, bottom pole segment 38 and top pole segment 40 are joined together by inserting the uncoated upper portion of bottom pole segment 38 into the open bottom end of top pole segment 40. This assembly may be secured by bolting the overlapping walls of the pole segments together. When the assembly has been completed, the seam 39 between the pole segments may be hidden by covering with the epoxy resin/hardener mixture, surface molding and painting to blend in with the rest of the tree trunk 12. Also before erecting tree trunk 12, mounting assemblies 60 and 100 may be assembled to C-shaped brackets 64, and mounting pipes 80, 82 and 114, respectively, fastened to the free ends thereof.

Tree trunk 12 may be lifted and positioned over foundation 45 by crane or otherwise and then lowered until base plate 42 is assembled onto bolts 47. Tree trunk 12 may be secured in this assembled position by fastening nuts 49 onto bolts 47. Desirably, a set of nuts 51 are threaded onto bolts 47 before base plate 42 is assembled thereon, nuts 51 providing a mechanism for adjusting the level of base plate 42 and therefore the angle of tree trunk 12 with respect to the ground.

With tree trunk 12 installed in an erect position, transmitting antennas 22 and receiving antennas 24 may be assembled to the respective mounting pipes. Transmitting antennas 22 and receiving antennas 24, the details of which are not shown, are conventional sector antennas for cellular communications and are available from manufacturers such as Motorola, Decibel Products, American Telephone and Telegraph, Erricson and others. One receiving antenna 24 may be clamped in a conventional fashion to each mounting pipe 80 and another receiving antenna 24 may be clamped in a similar fashion to each mounting pipe 82. The cable lead (not shown) from each receiving antenna 24 may be fed through the appropriate aperture 73 into arm 66, out therefrom through an aperture (not shown) in connecting plate 68, and then through aperture 65 in C-shaped bracket 64 and corresponding aperture 69 into the interior of pole 32. The cables may then travel down the interior of pole 32 and out from the base thereof through conduit 145 in foundation 45 and toward control room 5.

In addition, one transmitting antenna 22 may be clamped in a conventional fashion to each mounting pipe 114. The cable lead (not shown) from each transmitting antenna 22 may be fed through the appropriate aperture 115 into arm 102, then out therefrom through an aperture (not shown) in connecting plate 104, through apertures 65 and 69 into the interior of pole 32, and finally out from the base of pole 32 and through conduit 145 toward control room 5.

With transmitting antennas 22 and receiving antennas 24 in place, the assemblies consisting of tree limbs 14, branches 16 and needles 18 may be joined to tree trunk 12 by placing same over the appropriate pipes 50 and bolting same in place. The seam between the limbs 14 and tree trunk 12 may be concealed by filling the seam with some of the epoxy resin/hardener mixture and painting. The limbs 14, branches 16 and needles 18 in the assembled position substantially obscure the transmitting and receiving antennas and mounting assemblies 60 and 100 from view, but do not interfere with the radio signals being transmitted to and from the antennas.

It will be appreciated that the antenna support structure 10 of the present invention may be used to support other types of antennas, such as, for example, antennas for paging systems and antennas for personal communication systems. In this regard, the configuration of mounting assemblies 60 and 100 may be altered to accommodate different types and numbers of antennas. Thus, while mounting assemblies 60 and 100 described above allow for the mounting of three transmitting antennas 22 and six receiving antennas 24, other arrangements of mounting assemblies may be devised for mounting an additional number of antennas or for mounting the antennas in a different configuration. In such event, the placement of tree limbs 14, branches 16 and foliage assemblies 150 may be altered so that the antennas and their mounting assemblies are adequately obscured.

In one alternate embodiment, shown in FIG. 8, arm 66 may be provided with pipes 160 and 162 projecting from the sides thereof and a pipe 164 extending outwardly from bracket 70 concentrically with aperture 73. Pipes 160, 162 and 164 are similar to pipes 50 and serve the same function, i.e. they provide connection points for connecting tree limbs 14 to mounting assembly 60 to more completely obscure mounting assembly 60 and the receiving antennas connected thereto from view. In this embodiment, arm 66 is provided with an aperture 166 for routing the cable leads from the receiving antennas into arm 66 and then into pole 32.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. An antenna support structure, comprising a frame including an elongated hollow pole extending from a base end to a top end and a plurality of pipe assemblies connected to said pole, each of said pipe assemblies including a series of nonmetallic pipe segments connected to one another beginning with a first pipe segment connected to said pole and ending with an nth pipe segment defining at least one free end of said pipe assembly, each one of said pipe segments having a diameter, said diameter of each one of said pipe segments in said series decreasing from said diameter of said first pipe segment to said diameter of said nth pipe segment, means for connecting said base end of said pole to the ground, a layer of a coating material applied over said frame and textured to resemble tree bark, said coated frame defining a tree trunk and a plurality of tree limbs and tree branches, a plurality of foliage assemblies connected to said tree limbs and tree branches, each of said foliage assemblies including a nonmetallic stem and a multiplicity of strips of a nonmetallic material joined to said stem, and mounting means for mounting a plurality of antennas to said pole proximate said top end, said mounting means including a first series of brackets for mounting ones of said plurality of antennas at a spaced distance from said pole and a second series of brackets for mounting others of said plurality of antennas to said pole at a distance greater than said spaced distance, said mounting means being adapted to mount said plurality of antennas to said pole so that said plurality of antennas are substantially obscured by said plurality of tree limbs and tree branches and said plurality of foliage assemblies.

2. An antenna support structure, comprising a frame including an elongated pole extending from a base end to a top end and a plurality of elongated assemblies projecting from said pole, means for connecting said base end of said pole to the ground, a layer of a coating material applied over said frame and textured to resemble tree bark, said coated frame defining a tree trunk and a plurality of tree limbs and tree branches, a plurality of foliage assemblies connected to said tree limbs and tree branches, and mounting means for mounting a plurality of antennas to said frame proximate said top end of said pole, said mounting means including a first series of brackets having an inner end connected to said pole and a free end, said free ends of said first series of brackets being adapted to mount ones of said plurality of antennas at a spaced distance from said pole, and a second series of brackets having an inner end connected to said pole and a free end, said free ends of said second series of brackets being adapted to mount others of said plurality of antennas at a distance from said pole greater than said spaced distance.

3. The antenna support structure as claimed in claim 2, wherein said plurality of tree limbs and tree branches and said plurality of foliage assemblies are positioned relative to said first and second series of brackets so as to substantially obscure said first and second series of brackets.

4. An antenna tower, comprising a frame including an elongated pole extending from a base end to a top end and a plurality of elongated assemblies projecting from said pole, means for connecting said base end of said pole to the ground, a layer of a coating material applied over said frame and textured to resemble tree bark, said coated frame defining a tree trunk and a plurality of tree limbs and tree branches, a plurality of foliage assemblies connected to said tree limbs and tree branches, a plurality of antenna units, and mounting assemblies mounting said plurality of antenna units to said frame proximate said top end of said pole so that said plurality of antenna units are substantially obscured by said plurality of tree limbs and tree branches and said plurality of foliage assemblies.

5. The antenna tower as claimed in claim 4, wherein each of said elongated assemblies includes a series of segments connected to one another beginning with a first segment connected to said pole and ending with an nth segment defining at least one free end of said elongated assembly.

6. The antenna tower as claimed in claim 5, wherein each one of said segments in said series has a diameter, said diameter of each one of said segments in said series decreasing from said diameter of said first segment to said diameter of said nth segment.

7. The antenna tower as claimed in claim 5, wherein said series of segments comprise nonmetallic pipe segments.

8. The antenna tower as claimed in claim 4, wherein each of said foliage assemblies includes a nonmetallic stem and a multiplicity of strips of a nonmetallic material joined to said stem.

9. The antenna tower as claimed in claim 4, wherein said mounting assemblies include a first and second series of brackets each having an inner end connected to said pole and a free end, said free ends of said first series of brackets mounting ones of said plurality of antenna units at a spaced distance from said pole, and said free ends of said second series of brackets mounting others of said plurality of antenna units at a distance from said pole greater than said spaced distance.

10. The antenna tower as claimed in claim 9, wherein said plurality of tree limbs and tree branches and said plurality of foliage assemblies are positioned relative to said first and second series of brackets so as to substantially obscure said first and second series of brackets.

11. The antenna tower as claimed in claim 4, wherein said mounting assemblies mount said plurality of antennas to said pole so that said plurality of antennas are substantially obscured by said plurality of tree limbs and tree branches and said plurality of foliage assemblies.

* * * * *